United States Patent [19]

Lampe

[11] 4,126,843

[45] Nov. 21, 1978

[54] ATTACHMENT OF INSULATING COLLARS

[75] Inventor: Wolfgang Lampe, Ludvika, Sweden

[73] Assignee: Asea AB, Vasteras, Sweden

[21] Appl. No.: 776,455

[22] Filed: Mar. 10, 1977

[30] Foreign Application Priority Data

Mar. 15, 1976 [SE] Sweden ..... 7603261

[51] Int. Cl.[2] ..... H01F 15/04; H01F 27/30

[52] U.S. Cl. ..... 336/84 C; 336/196; 336/197

[58] Field of Search ..... 336/84 C, 197, 84 R, 336/196, 198; 310/214

[56] References Cited

U.S. PATENT DOCUMENTS

| | | | |
|---|---|---|---|
| 2,847,650 | 8/1958 | Glassanos | 336/197 |
| 3,381,252 | 4/1968 | Lutz | 336/197 |
| 3,786,387 | 1/1974 | Hori et al. | 336/197 X |
| 3,936,784 | 2/1976 | Elfgren et al. | 336/197 X |

*Primary Examiner*—Thomas J. Kozma

*Attorney, Agent, or Firm*—Watson, Cole, Grindle & Watson

[57] ABSTRACT

A device for the attachment of insulating collars in the yoke insulation build-up of insulating spacers in transformers with the yoke insulation arranged between the core yoke and the winding ends wherein the respective surfaces of the spacers facing each other are provided with recesses and elevations respectively for fixedly holding the portion of the insulating collars located between two spacers in the yoke insulation.

5 Claims, 9 Drawing Figures

ATTACHMENT OF INSULATING COLLARS

BACKGROUND OF THE INVENTION

The compression pressure which is necessary for securing transformers against short-circuits, which pressure is exercised from the core yokes on the windings, must be transmitted through the insulation between the winding ends and yokes, the so-called yoke insulation. This yoke insulation includes a number of insulating spacers, and generally also insulating collars, for achieving an extension and vision of the spark length between the winding ends and yokes. To hold the collars in position, part of the collar, the so-called collar foot, is inserted between two spacers. When compression pressure is applied, the foot of the collar is firmly attached between two spacers by pressing. The material in the collar may often have poorer yielding and setting properties than the material of the spacer which can be used. Thus, the foot of the collar may become deformed by yielding under the influence of a quite normal compression pressure, which causes the compression pressure on the winding, necessary for securing against short-circuits, to be reduced; and in extreme cases the collars may become detached. This is true not only in the case of pressboard collars, but also for collars made of plastic material (e.g. polyolefins), which may sometimes be desirable to use because of their low dielectric constant.

SUMMARY OF THE INVENTION

According to the present invention, the above-mentioned disadvantages are avoided by forming the surfaces of the spacers facing each other with recesses and/or elevations which cooperate in holding fixed the portion of the collars which is located between two spacers in the yoke insulation.

Since the spacers and the collars according to a first embodiment of the invention are designed so that the spacers are in direct contact with one another, the collars are not at all, or only slightly, influenced by the compression pressure. Since the spacers can be manufactured from, for example, glass-fiber reinforced plastic which withstands very high pressures without becoming deformed, this results in a yoke insulation which is practically totally insensitive to yielding and which therefore maintains its shape. According to a second embodiment of the invention, the spacers are designed so that a more or less closed space is formed between them, the space being practically entirely filled by the spacer material. The spacer material filling the space then transmits a substantial part of the compression pressure because the enclosed spacer material is prevented from yielding.

DETAILED DESCRIPTION

Figure 1A:
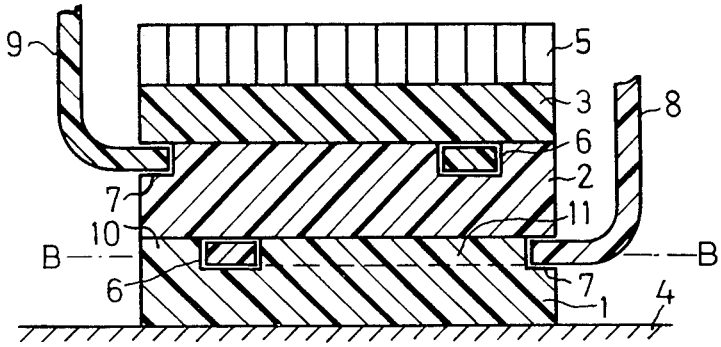
FIG. 1*a* shows a cross-section through a yoke insulation according to the invention.

FIG. 1*a* shows a yoke insulation, including three spacers 1, 2 and 3, arranged between the lower yoke of 4 of a transformer core (not shown) and the lowermost disc 5 of a disc winding. On their upper sides the spacers 1 and 2 are provided with two recesses 6 and 7, the depths of which approximately correspond to the thicknesses of collars 8 and 9. Between the recess 6 and the nearest end of spacer 1 there is formed an elevation 10, and between the two recesses there is formed a second elevation 11. In the portion of the collars which in mounted position are located between the spacers, the so-called collar foot, the collars are provided with a rectangular hole 12 which is insignificantly larger than the cross-sectional area of the elevation 11 between the two recesses 6, 7 of the spacer. When the collar 8 has been placed over the spacer 1 with the hole 12 of the collar engaging the elevation 11, the spacer 2 can be placed on top of the clack 1 and make direct contact therewith, the foot of the collar thus being squeezed between the two spacers. The compression pressure acting between the winding and the yoke is transmited by the spacers only, whereas the collars remain substantially unifluenced by the compression pressure.

Figure 2A:
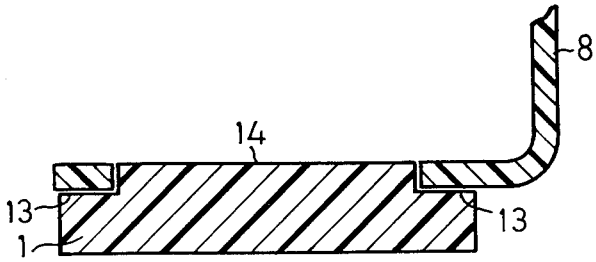
FIG. 2*a* shows a cross-section through a spacer and part of the collar according to another embodiment.
Figure 2B:
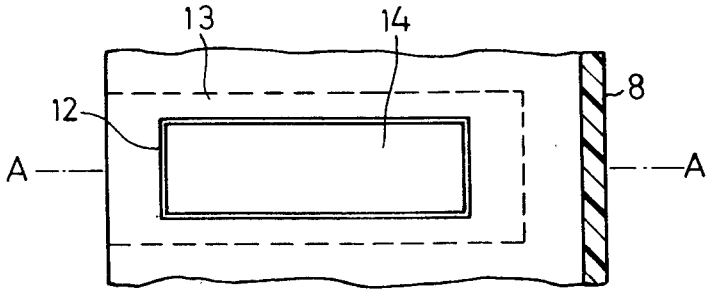
FIG. 2*b* shows a top view of FIG. 2*a;*

The spacers can also be formed as shown in FIGS. 2*a* and 2*b* with one lower portion 13 all around the spacer, which then corresponds to the previously shown recesses, and with a higher portion 14 at the center corresponding to the elevations. The hole 12 of the collar then surrounds the central elevation 14.

Figure 1B:
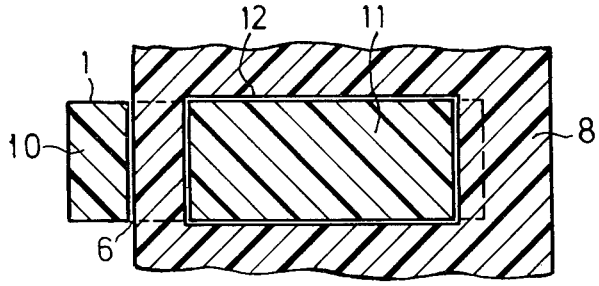
FIG. 1*b* shows a section along the line B—B of FIG. 1*a;*
Figure 3A:
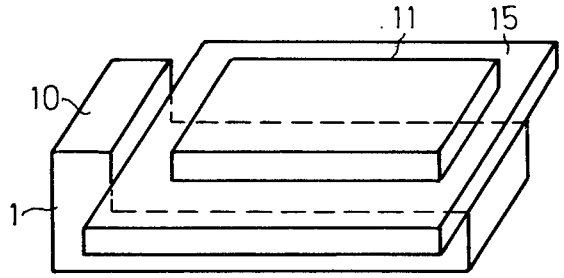
FIG. 3*a* is a perspective view of a spacer.
Figure 3B:
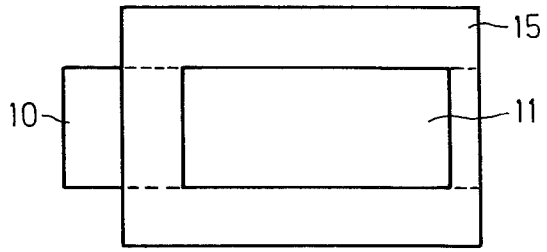
FIG. 3*b* is a top view of FIG. 3*a;*

The purpose of the collars 8 and 9 is to form a labyrinth-like extension of the spark length between the winding and the yoke. Since it is possible that a narrow gap may successively form between the foot of the collar and the spacers and through the hole 12 in the foot of the collar, and that such a gap may form a path for a discharge between the winding and the yoke through the collar, it may in some cases be appropriate to arrange a screen on the spacers, as shown in FIGS. 3*a* and 3*b*. FIG. 3*a* shows how the spacer 1 in FIG. 1 is provided with a screen 15, placed around the elevation 11 and projecting somewhat outside the spacer on at least two sides thereof. It is then suitable to glue the screen to the spacer so that there is no risk of a discharge along the sides of the spacer. The collar is placed on top of the screen so that its hole 12 surrounds the portion of the elevation 11 which projects over the screen.

Figure 4B:
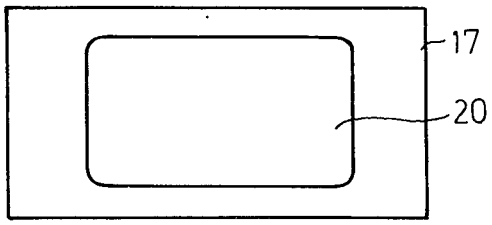
FIG. 4*b* shows the under side and FIG. 4*c* the upper side of a spacer.
Figure 4A:
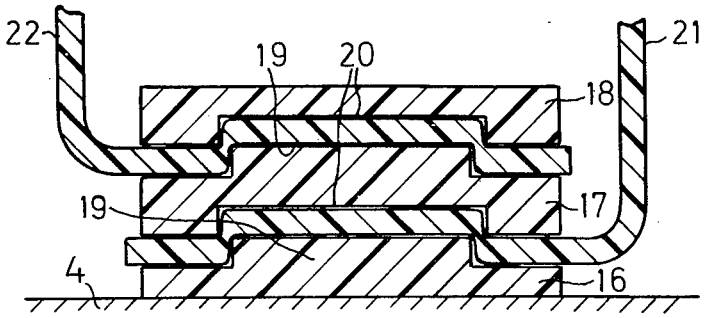
FIG. 4*a* is a section through a yoke insulation with three spacers and two collars according to another embodiment of the invention.
Figure 4C:
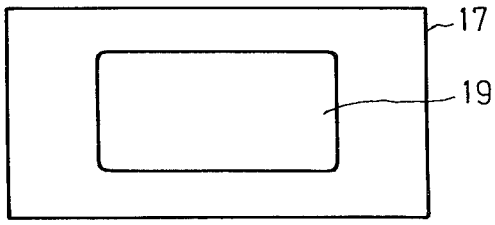

Another example of the application of the invention is shown in FIG. 4*a,* which is a section through a yoke insulation consisting of three spacers 16, 17, and 18, of which spacer 16 is located nearest to the yoke 4. The spacer 16 has a elevation 19 in its upper side and the middle spacer 17 has a recess 20 on its lower side and an elevation 19 on its upper side. FIG. 4*b* shows the spacer 17 seen from below and FIG. 4*c* shows the spacer 17 seen from above. From all the FIGURES is is clear that the elevation 19 has smaller dimensions than the recess 20. The material in the collars 21 and 22 is plastically deformable, such that if the collars are placed with their feet between two spacers and a sufficiently great pressure is applied, the material of the collar will flow out and fill up the entire space between the recess 20 and the elevation 19. The gap which is formed in a lateral direction between the elevation and the recess when the spacers are pressed against one another, is, however, so small that only an insignificant portion of the material of the collar can be pressed out of the space. The compression pressure will therefore be transmitted by the portion of the collar material which is enclosed in the space. In this way the collar is also safely attached between the spacers.

In a modification of the device shown in FIG. 4*a*, the elevation 19 is made somewhat higher than the depth of the recess 20, and a thermoplastic type material is used in the collars. With the collars placed between the spacers and after a short period of heating, the spacers are pressed against each other so that the elevation 19 is pressed through the material of the collar and makes contact with the recess. In the area outside the recess 20 the distance between the spacers is larger and in that area part of the material of the collar remains, which holds the collar fixed between the spacers.

I claim:

1. In an electrical transformer having a core yoke and winding ends with yoke insulation arranged therebetween, said yoke insulation comprising: a plurality of spacers arranged in tiered relationship with one another, the confronting surfaces of at least two adjacent spacers including at least one recessed portion and at least one elevated portion, a plurality of insulating collars, a portion of at least one collar being arranged between said two adjacent spacers and retained by said recessed portions and said elevated portions.

2. Yoke insulation according to claim 1, in which that portion of said at least one collar arranged between said at least two adjacent spacers includes an aperture, and at least one of said confronting surfaces includes a corresponding projecting portion located in said aperture to make contact with the other confronting surface, and said at least one collar surrounding the projecting portion of said confronting surface and thereby being retained in the yoke insulation.

3. Yoke insulation according to claim 2, in which at least one of said spacers includes a screen surrounding part of said elevated portion and extending outside said at least one spacer on at least two of the sides thereof, said screen having a height less than the height of said elevated portion.

4. Yoke insulation according to claim 1, in which said confronting surfaces each include one recessed portion and one elevated portion, with the recessed portion of one said confronting surface nested within the elevated portion of the other of said confronting surface and vice-versa, each said at least one collar mounted between said two confronting surfaces being deformable and substantially filling the space between the respective nested recessed portions and elevated portions by the compression pressure of the winding.

5. Yoke insulation according to claim 4, in which the elevated portion of each confronting surface has greater height than the corresponding recessed portion of the other confronting surface, said collar being deformable and each elevated portion is pressed against the bottom of the corresponding recess portion by heating and sufficiently high pressure to penetrate that portion of each said collar arranged between the corresponding one of said two adjacent spacers to make contact with the recess bottom.

* * * * *